United States Patent [19]

Tobias

[11] Patent Number: 4,969,646

[45] Date of Patent: Nov. 13, 1990

[54] GOLF BALL TEE PLACEMENT DEVICE

[76] Inventor: Wesley J. Tobias, 17620 Co. Line 3, Def./Henry, New Bavaria, Ohio 43548

[21] Appl. No.: 225,530

[22] Filed: Jul. 28, 1988

[51] Int. Cl.[5] ..... A63B 57/00

[52] U.S. Cl. ..... 273/32.5

[58] Field of Search ..... 273/32.5

[56] References Cited

U.S. PATENT DOCUMENTS 2,609,198 9/1952 Armstrong ..... 273/32.5

*Primary Examiner*—William H. Grieb

*Attorney, Agent, or Firm*—George R. Royer

[57] ABSTRACT

An apparatus for placement of golf balls and golf tees comprising a longitudinally extending frame member with a longitudinal central axis where the frame member has a generally longitudinally extending internal chamber of cylindrical disposition with such longitudinal chamber having an axis which is coaxially aligned with the longitudinal central axis of the frame member. The internal chamber holds therein a longitudinally extending movable plunger rod, which plunger rod member extends out from the opposing ends of the chamber. Integrally disposed on the exposed lower end of the plunger rod member is a cap having a semispherically-shaped concave bottom to rest conformingly against the upper spherical surface of the golf ball. Extending integrally from the bottom of the longitudinal frame member is a secondary frame member, the bottom end of which is adapted to temporarily hold a golf tee with a golf ball thereon.

3 Claims, 1 Drawing Sheet

3
150
140
80
50
82
123A
123B
126A
126B
120
81
70
3
100
40
10
195A
195B
280
90
A
B
150
210A
30
C
260
E
20
83

150
140
100
80
50
180
82
120
81
70
40
10
195B
28
90
210A
150
30
4
D2
260
D1
20
83

150
80
50
82
120
100
40
70
10
81

210A
C
260
30
300
20
310
300
260
310
D2
D
210B

GOLF BALL TEE PLACEMENT DEVICE

DESCRIPTION OF PRIOR ART AND BACKGROUND OF INVENTION

This invention is directed to athletic gear and equipment in general, with the most specific application being to the game of golf. The invention is particularly directed to a means to aid in the placement into the ground of a golf ball and golf tee without requiring any appreciable bending on the part of the player. More specifically, the subject invention is addressed to the task of placing a golf ball poised on a golf tee into the ground to ready the ball for play.

In this area of sporting equipment there are no known devices which can be used to place the golf ball and tee together into position in the playing surface with the tee bottom inserted into the ground with the ball already positioned on top. Moreover, there are no such devices that have the additional features of helping to accomplish such indicated result so that the player need not have to physically bend over in the process. Such a feature permits persons who are physically restricted from bending over for the purpose of placement of golf tees into the ground. Otherwise, many otherwise physically qualified and capable golfers are restricted completely from playing the game unless a second person is always present to perform this task. Of course, for many this becomes economically prohibitive.

In view of the foregoing it is the purpose of the subject invention to provide a device for enabling golfers to place golf tees in the ground with the ball thereon, or similar such objects, without the need of significant bending at the waist, the following objects of the subject invention are directed accordingly.

OBJECTS

It is an object of the subject invention to provide an improved device to aid in the game of golf.

Another object of the subject invention is to provide an improved apparatus to aid people in placement of golf balls and golf tees in the playing position without the need of significant physical bending at the waist;

Yet another object of the subject invention is to provide an efficient mechanism for the placement of golf balls and golf tees into the ground so that little bending or moving over is required to place them in the ground;

Still Another object of the subject invention is to provide a sports assist device;

Other and further objects of the subject invention will become apparent from a reading of the specification, taken in conjunction with drawings.

DRAWINGS

DESCRIPTION OF GENERAL EMBODIMENT

An apparatus for placement of golf balls and golf tees comprising a longitudinally extending frame member with a longitudinal central axis where the frame member has a generally longitudinally extending internal chamber of cylindrical disposition with such longitudinal chamber having an axis which is coaxially aligned with the longitudinal central axis of the frame member. The intenal chamber holds therein a longitudinally extending movable plunger rod, which plunger rod member extends out from the opposing ends of the chamber. Integrally disposed on the exposed lower end of the plunger rod member is a cap having a semispherically-shaped concave bottom to rest conformingly against the upper spherical surface of the golf ball. Extending integrally from the bottom of the longitudinal frame member is a secondary frame member, the bottom end of which is adapted to temporarily hold a golf tee with a golf ball thereon.

DESCRIPTION OF PREFERRED EMBODIMENT

In describing the preferred embodiment of the subject invention, it is to be noted that the following description shall be of one embodiment only of several that are within the scope of the invention herein, and this description of a particular embodiment shall not be considered as limiting the scope of the invention herein. Moreover, in describing the subject invention, the following nomenclature shall be used. The word "upper" shall refer to those areas above the ground level, while the word "lower" will refer to those areas adjacent or near the ground level as appertaining to a device vertically disposed relative to the ground.

Figures 1, 2, 3, 4:
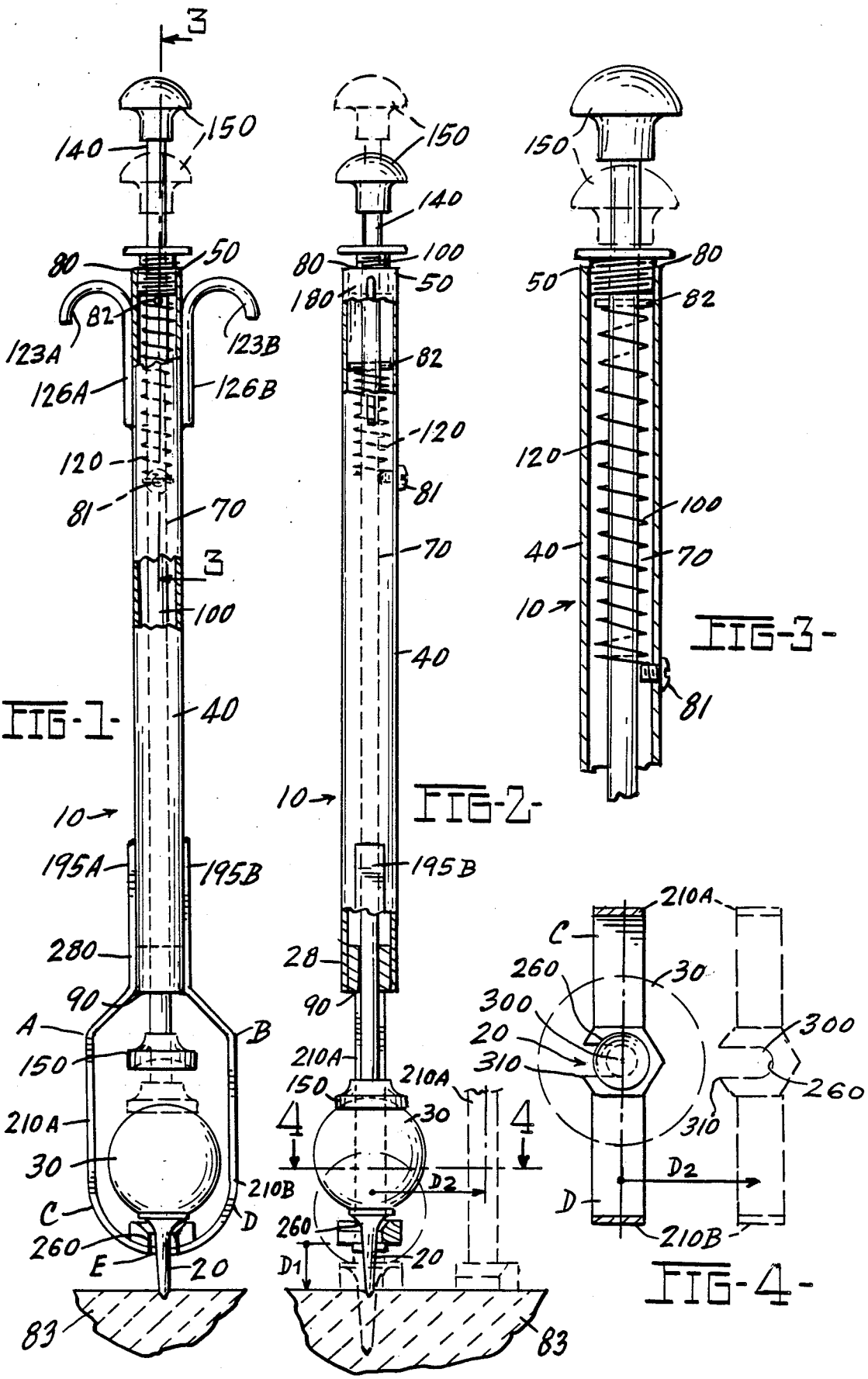
FIG. 1 is a front elevational view of the subject device shown partially in section.
FIG. 2 is a side elevational view of the subject device shown partially in section.
FIG. 3 is a front elevational view showning how the subject device is used.
FIG. 4 is a top elevational view of the tee holder.
Figure 3:
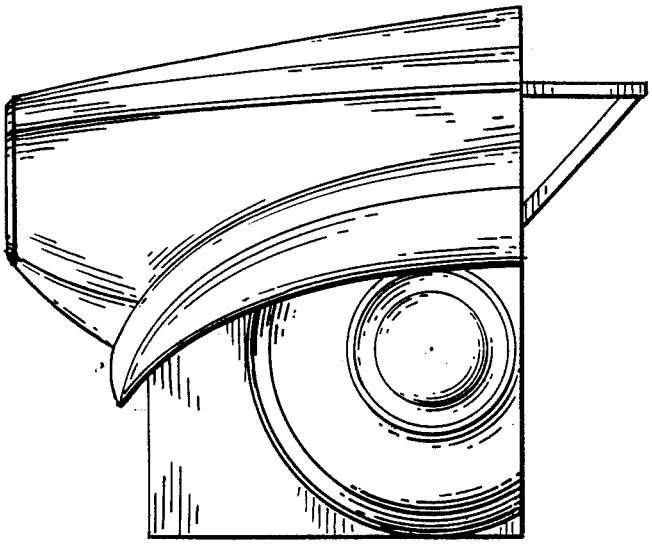
Figure 4:
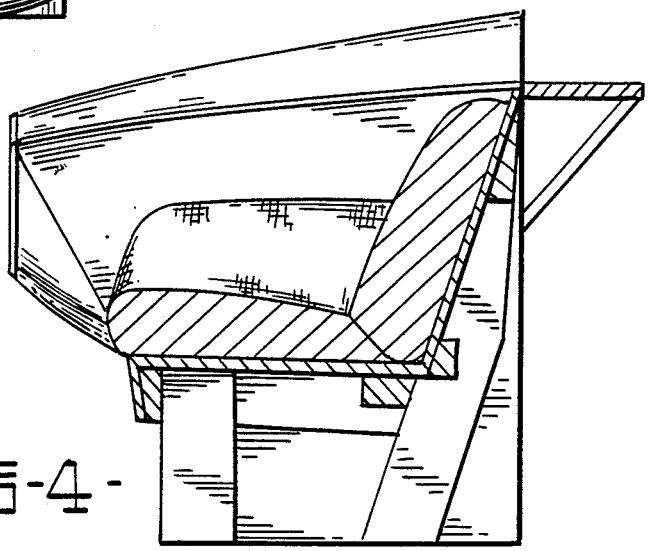
Figure 5:
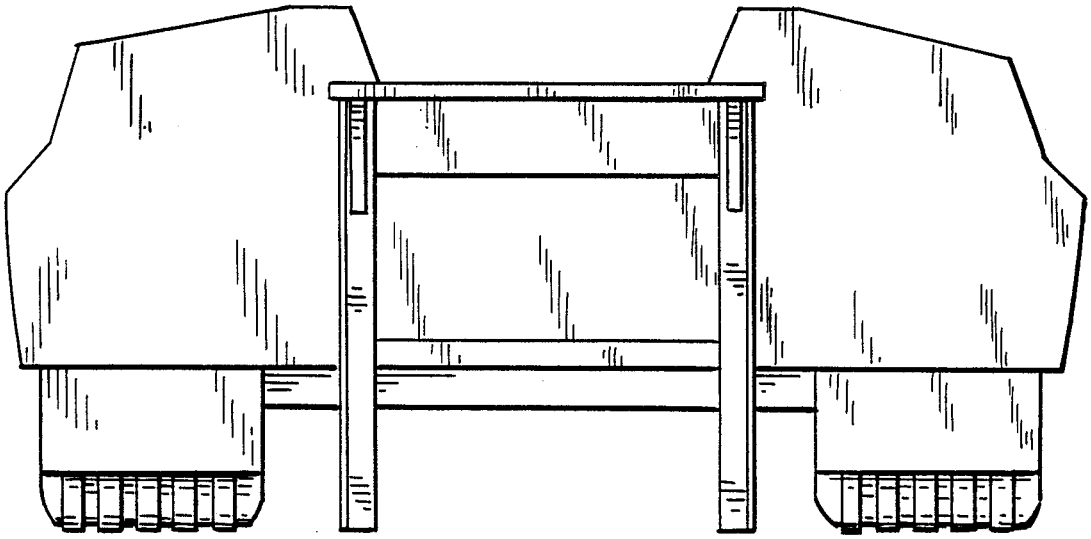

Referring now to the drawings in which a preferred embodiment of the subject invention is shown and particularly to FIGS. 1, 2, and 3, a combined golf ball and golf ball tee emplacement apparatus 10 is shown. As seen in the drawings, the subject device is an apparatus 10 adapted for inserting a golf ball tee 20 with a golf ball 30 on top of the tee in the ground to ready same for golf play, which apparatus comprises a longitudinally extending base frame member 40 with a first end 50 and a second end 60, said second end being generally also referred to as the lower end, and the first end being referred to as the upper end, such frame member 40 having a hollow, longitudinally extending interior chamber 70 extending from the first end of such base member to the second or lower end of the base member, with such chamber having openings 80 and 90 respectively at the first end and second end of said base frame member 40, which openings 80 and 90 communicate with the areas between the outside hollow chamber 70 to the spatial areas inside such chamber. The longitudinally extending frame member houses a longitudinally extending plunger member 100 slidably mounted in such chamber 70 with spring bias means 120 in said interior chamber 70, said longitudinally extending plunger means extending through said chamber and beyond each end thereof having a handle end 140 on the first or upper end 50 and cap means 150 on the second end, which cap means has a concave indention of semispherical shape with frame member, having tee insert means on a portion of same frame extension member.

As can be seen from the drawings, the internal chamber 70 is generally of cylindrical configuration and has therein a bearing mount 180 adjacent the first end 50 and a similar bearing mount in the lower part of the chamber 70, not shown. These latter bearing mounts are of conventional disposition, and interspersed in between such mounts is the bias spring 120 as shown, such bias spring being employed to bias the plunger rod in the upper retracted position shown in FIG. 1. Shown in phantom in FIG. 1 is the depressed position in which the rod is pushed downward to effect placement of the golf ball 30 and tee 20 in the ground.

Integrally disposed on the bottom of the frame member 40 is tee holding frame member 200, alternately referred to as a bottom frame member 200. Such bottom frame member 200 is comprised of two parallel members extending as symmetrically extending opposing bands 210A and 210B. Specifically, opposing bands 210A and 210B are integrally affixed to the outer bottom surface 280 of the base frame member 40 and extend downwardly embraced in a flush manner against the outer bottom surface 280, as shown in FIG. 1, to the bottom extreme of the base. As can be seen from a view of FIG. 1, the two opposing bands 210A and 210B diverge from one another in inverted V fashion for a minimal distance and then at points A and B the bands descend vertically downwardly a further distance to points C and D on each band member 210A and 210B, and at this point the bands 210A and 210B bend inwardly in a curved manner to a meeting point E. At point E where bands 210A and 210B converge towards one another, as seen, at this convergence point E there is a U-shaped insert device 260 as seen in FIGS. 1 and 4, which U-shaped insert device is disposed horizontally so that it is parallel to the ground. The opening formed in the U-shaped device has an internal opening 300 with outer opening 310. The lower shank of a golf tee 20 is adapted to fit into such opening 300 with a golf ball thereon, and which is then inserted into the ground with the aid of plunger cap 150 being pressed against the ball 30.

In summary, the subject invention is a device for emplacing a tee and a golf ball in the ground and comprises a longitudinal shaft member with a hollow longitudinally extending central chamber, such chamber being adapted to reciprocally hold a plunger member, and a longitudinally extending plunger member longitudinally extending in the central chamber of such longitudinal shaft member, and first means on the end of such longitudinal member to hold a tee, with second means on such first means to hold a golf ball.

Alternately stated, the subject invention in a device for emplacing a tee and a golf ball in the ground comprising a longitudinal shaft member with a hollow longitudinally extending member extending in the central chamber of such longitudinal shaft member; and a longitudinally extending plunger member longitudinally extending in the central chamber of such longitudinal shaft member, and feet means on the end of said longitudinal member to hold a tee, and said means on such first means to hold a golf ball.

Stated yet another way the subject invention is a device for employ of a tee and a golf ball in the ground comprising a longitudinal shaft member with a hollow longitudinally extending central chamber such chamber being adapted to reciprocally hold a plunger member, and a longitudinally extending plunger member longitudinally extending in the central chamber of such longitudinal shaft member, and first means on the end of said longitudinal member to hold a tee, with second means on such first means to hold a golf ball.

I claim:

1. A device for emplacing a golf tee and a golf ball in the ground comprising:

(a) a longitudinal shaft member with a hollow longitudinally extending central chamber, said chamber being adapted to reciprocally hold a longitudinally extending plunger member;

(b) a longitudinally extending plunger member longitudinally extending in the central chamber of said longitudinal shaft member;

(c) first means on the end of said longitudinal member to hold a golf tee, said first means comprising a looped member having frontal and posterior portions which frontal and posterior portions are open, and said first means having a bottom portion and a top portion;

(d) second means integrally disposed on said first means to hold a golf ball, said second means being affixed to the bottom portion of said frontal means and raised above the level of said first means.

2. A device for emplacing a golf tee and a golf ball in the ground comprising:

(a) a longitudinal shaft member with a hollow longitudinally extending in the central chamber of said longitudinal shaft member;

(b) a longitudinally extending plunger member longitudinally extending in the central chamber of said longitudinal shaft member;

(c) feet means on the end of said longitudinal member to hold a tee;

(d) said means on said first means to hold a golf ball.

3. A device for emplacing a golf tee and a golf ball in the ground comprising:

(a) a longitudinal shaft member with a hollow longitudinally extending central chamber said chamber being adapted to reciprocally hold a plunger member;

(b) a longitudinally extending plunger member longitudinally extending in the central chamber of said longitudinal shaft member;

(c) first means on the end of said longitudinal member to hold a tee;

(d) second means on said first means to hold a golf ball, (e) handle gripping means in the form of semicircular members disposed integrally to the longitudinal shaft member.

* * * * *